US007171993B2

(12) United States Patent
Bethuy et al.

(10) Patent No.: US 7,171,993 B2
(45) Date of Patent: Feb. 6, 2007

(54) BEVERAGE DISPENSER WITH AUTOMATIC CUP-FILLING CONTROL

(75) Inventors: Timothy W. Bethuy, New Fairfield, CT (US); Andrew D. Nelson, Appleton, WI (US); Gary Blank, Neenah, WI (US); Anthony V. Salsich, Appleton, WI (US)

(73) Assignee: PepsiCo, Inc., Purchase, NY (US)

( * ) Notice: Subject to any disclaimer, the term of this patent is extended or adjusted under 35 U.S.C. 154(b) by 91 days.

(21) Appl. No.: 11/118,657

(22) Filed: Apr. 29, 2005

(65) Prior Publication Data

US 2006/0144464 A1 Jul. 6, 2006

Related U.S. Application Data

(60) Provisional application No. 60/572,965, filed on May 21, 2004.

(51) Int. Cl.
*B65B 1/30* (2006.01)

(52) U.S. Cl. ..... 141/198; 141/95; 141/360; 141/362; 137/392; 222/641

(58) Field of Classification Search ..... 141/2, 141/18, 83, 94, 95, 198, 351, 360, 362; 222/640, 222/641; 137/392; 340/616, 618, 620
See application file for complete search history.

(56) References Cited

U.S. PATENT DOCUMENTS 3,902,636 A 9/1975 Zilk
4,712,591 A 12/1987 McCann et al.
4,944,332 A 7/1990 Belland
4,972,883 A 11/1990 Hassell et al.
4,974,643 A 12/1990 Bennett et al.
5,190,188 A 3/1993 Credle, Jr.
5,228,486 A 7/1993 Henninger
6,058,986 A 5/2000 Bethuy et al.
6,286,721 B1 9/2001 Pellegrini
6,684,920 B2 2/2004 Seitz

FOREIGN PATENT DOCUMENTS

WO WO 03/026966 4/2003

*Primary Examiner*—Timothy L. Maust
(74) *Attorney, Agent, or Firm*—Banner & Witcoff, Ltd.

(57) ABSTRACT

A beverage dispenser for filling a container preferably has a nozzle through which the beverage is discharged and a pivoting lever located underneath the nozzle that detects the placement of a container so as to regulate the actuation of the dispenser. A conductive probe is in line with the discharged beverage stream, the lever also being conductive. A signal generator generates a varying-over-time signal that is applied to the probe or lever. As a result of beverage overflowing the container, the beverage stream establishes a conductive path between the probe and lever. The signal through this conductive path is compared to the signal produced by the signal generator. If the signals are substantially identical for a select period of time, the dispensing system is considered to be in an overflow state, and beverage dispensing is terminated.

20 Claims, 2 Drawing Sheets

BEVERAGE DISPENSER WITH AUTOMATIC CUP-FILLING CONTROL

RELATIONSHIP TO EARLIER FILED APPLICATION

Figure 1:
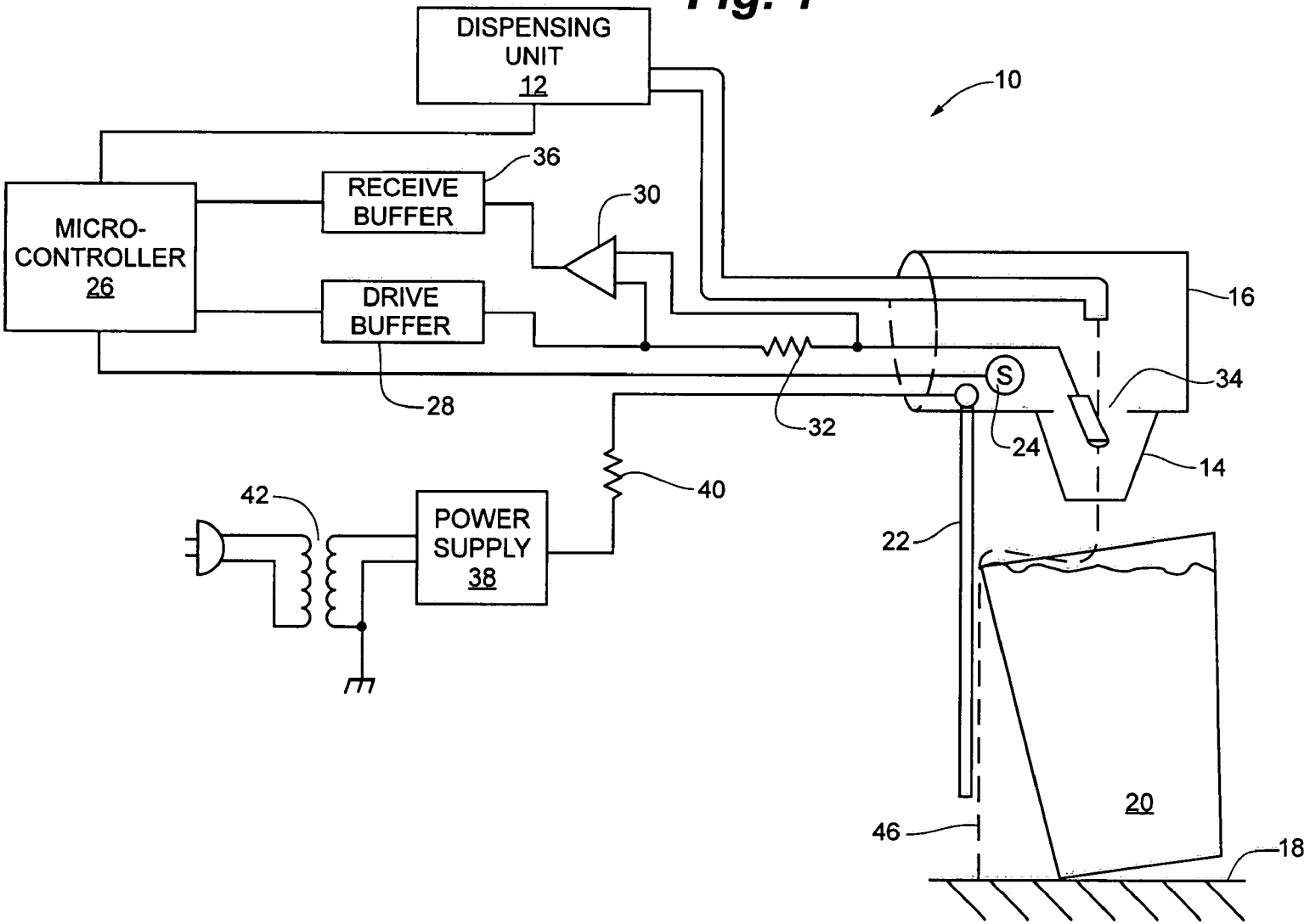

This application claims the benefit of U.S. Provisional Patent Application No. 60/572,965, filed May 21, 2004.

BACKGROUND OF THE INVENTION

1. Field of the Invention

The present invention relates to a beverage dispenser for dispensing a beverage into a container such as a cup. More particularly, this invention is related to a beverage dispenser that inhibits dispensing of the beverage when the container into which the beverage is dispensed is full.

2. Description of the Related Art

Beverage dispensers are used in many locations to deliver individual portions of beverages into drinking containers such as glasses or cups. Some, but not all, beverage dispensers mix a concentrate of the beverage with water, which may be carbonated, immediately prior to the actual discharge of the beverage into the container. Beverage dispensers of this type are used in restaurants and entertainment venues such as movie theaters and sports arenas. Some restaurants locate these dispensers in a public space so that patrons can obtain their own drinks. An advantage of so locating a beverage dispenser is that it frees the restaurant staff for other duties.

Many beverage dispensers, especially those designed to deliver cold beverages such as soft drinks and fruit drinks, include a dispensing head from which a nozzle extends. A lever is pivotally mounted to the dispensing head behind the nozzle. Located behind the nozzle are the concentrate containers, a water source and the fluid pumps and valves that control dispensing. The lever is shaped so that, for a person to obtain a beverage, the individual pivots the lever with the container as a consequence of positioning the container under the nozzle. A sensor integral with the dispensing system monitors the displacement of the lever. Based on this sensor generating a signal indicating that the lever has been displaced, a control circuit, also part of the dispensing system, opens the appropriate valve(s) and/or actuates the pump so as to force the discharge of the beverage.

Inevitably, when such a dispensing system is employed, persons using it will place containers underneath the nozzle for such a period of time that the amount of beverage discharged will first fill and then overflow the container. This overflowing occurs for a number of reasons: inattention to the dispensing process; an individual's desire to fill the container to the top; or simple mischievousness. These latter causes of container overfill are especially prone to occur when the dispensing system is placed in a location where patrons, not employees, use the system.

One disadvantage of this overflow problem is that it wastes beverage. A second disadvantage is that it creates needless liquid waste that must be contained and disposed.

A number of methods have been proposed to reduce, if not eliminate, the incidence of container overfill. One method that has been proposed is monitoring the volume of beverage discharged. Once the monitoring assembly determines that a volume of beverage sufficient to fill the container has been delivered, the dispensing system cuts off delivery of additional beverage. One disadvantage of this type of system is that at many locations where these dispensing systems are used, different sized containers are typically available. This means an individual must take the time to push the start button associated with the container to be filled in order to ensure that the container is properly filled. At a self-serve location, many patrons do not want to take the time in order to make sure they have properly actuated the dispensing system.

Another method that has been employed to minimize overfill involves real time monitoring of whether or not, beverage, upon being dispensed, is overflowing out of the container. This monitoring is accomplished by applying a current to the beverage. Typically, this current is applied by a probe integral with the nozzle from which the beverage is dispensed. The lever the individual pushes to actuate the dispenser functions as a second probe. As long as the dispensed beverage flows into the container, there is no conductive path between the two probes. Once beverage overflows the container, a fraction of the beverage stream flows over the lever. Since beverages are electrically conductive, the beverage forms a conductive current path between the nozzle probe and the lever. A sensing circuit monitors whether or not there is current flow through this circuit. When current flow is detected, the sensing circuit sends a signal to the dispenser controller so as to cause the system to stop dispensing.

The above-described system has some utility for detecting whether or not beverage is overflowing from a container. However, the signal path of this two probe circuit tends to be noisy. One solution to this problem, applying a high current to the one probe and monitoring the second probe is clearly unacceptable for safety reasons. Therefore, presently, in a dispensing system wherein this type of overflow monitoring/actuation control subs-system is employed, the subsystem is configured so that the detection of any low level current flow between the probes deactivates the system. A disadvantage of this arrangement is that, due to the presence of stray liquids around the dispensing system, the monitoring-actuation control system will sometimes generate a false positive signal that the beverage is overflowing the container when this event is not occurring. The resultant deactivation of the dispensing system even though a container is not completely full then becomes an irritant to the person trying to obtain a full cup of beverage.

SUMMARY OF THE INVENTION

This invention is related to a new and useful beverage dispensing system. The beverage dispensing system of this invention has a container overflow monitor assembly that only generates an overflow signal when the container being filled is overflowing for a period of time.

The dispensing system of this invention has an overflow monitor assembly that includes a signal generator. The signal generator outputs a variable signal, a signal other than a constant DC voltage. The output signal is applied to one of the two probes of a nozzle-lever probe pair. The output signal from the signal generator is also applied to a comparator. The sub-circuit formed by the probe pair is connected to the second input of the comparator.

As long as the beverage discharged into the container remains in the container, the probe pair sub-circuit does not have a conductive path. When the system is in this state, the comparator generates an output signal that indicates there is a difference between the two signals applied to it.

As beverage overflows the container, the beverage flows over the lever. The beverage thus becomes a conductor in the probe pair sub-circuit. The signal through this circuit is applied to the comparator. The comparator outputs a signal indicating that the signal from the signal generator and the probe pair sub-circuit are identical. The overflow monitor assembly has a timing circuit that monitors for how long these signals are identical. The indication by the timing circuit that the two signals have been identical for a select period of time is interpreted as an indication that beverage is, in fact, overflowing from the container.

BRIEF DESCRIPTION OF THE DRAWING FIGURES

Figure 2:
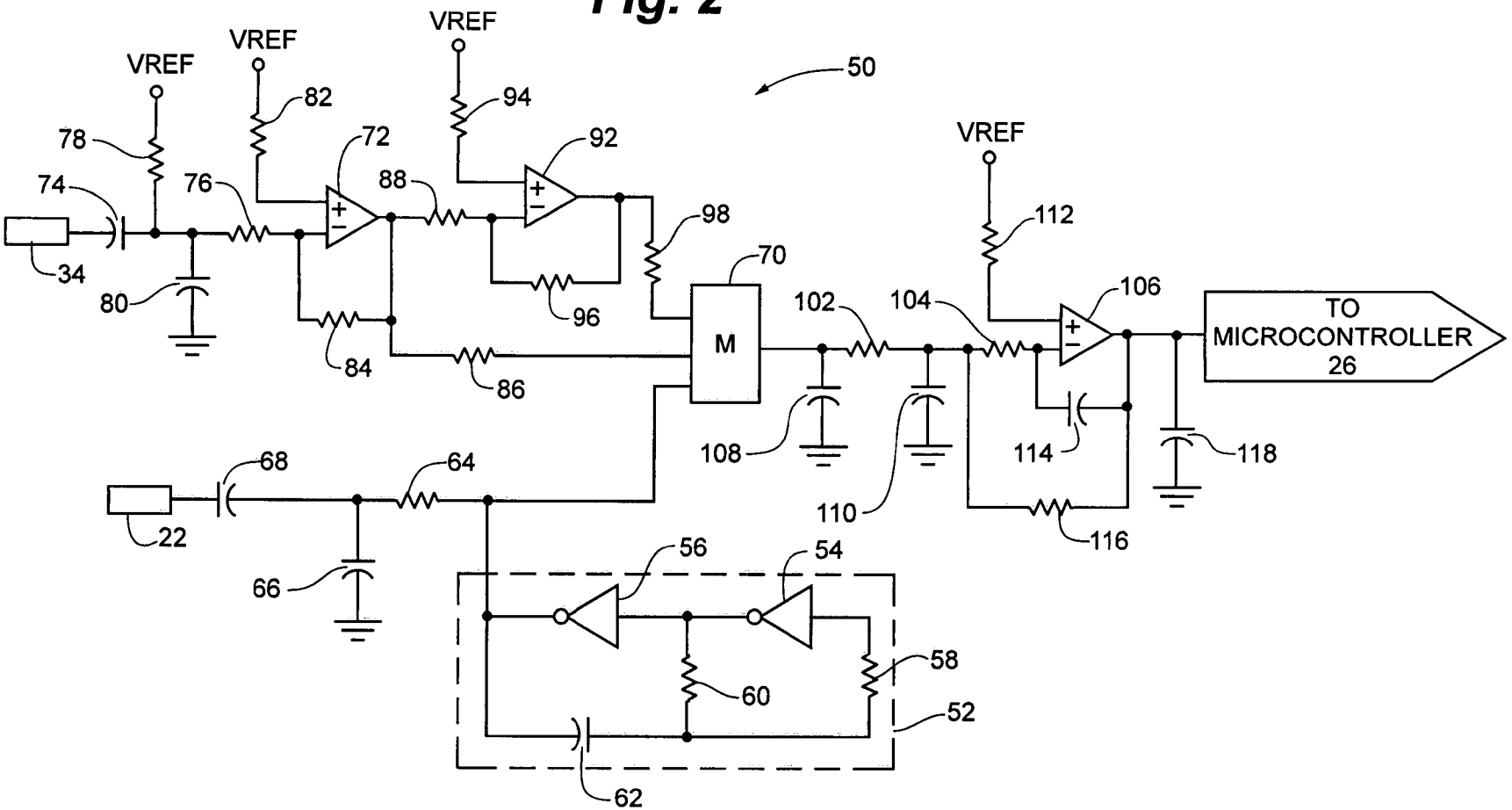

FIG. 1 is a block diagram and partial schematic drawing of a dispenser and monitoring and control system according the present invention; and FIG. 2 is a schematic diagram of an alternative monitoring system according to the present invention for determining whether or not beverage is overflowing from the container into which it is being discharged.

DETAILED DESCRIPTION OF THE PREFERRED EMBODIMENTS

A beverage dispenser with overflow monitor system 10 of this invention is now explained by reference to FIG. 1. System 10 includes a dispensing unit 12 for dispensing a beverage. While not illustrated, it is appreciated by those familiar with this technology that dispensing unit 12 typically includes a pump for forcing the beverage out through a nozzle 14. Nozzle 14 is mounted to a head assembly 16. Head assembly 16 suspends the nozzle 14 above a counter surface 18. This allows a container 20, such as a cup, to be placed on the counter surface 18 and filled. Integral with dispensing unit 12, there is also an electronically actuated valve (not shown) that regulates the flow of beverage out of the nozzle 14. It is to be understood that nozzle 14 and head assembly 16 are sometimes considered part of the dispensing unit 12.

Dispensing unit 12 also has a lever 22 that is pivotally mounted to the head assembly 16 adjacent the nozzle 14. Lever 22 is shaped so that a portion of the lever extends into the space in which a container 20 is placed under the nozzle 14 in order to fill the container. Lever 22 is usually pivotable about an axis located at the upper end thereof. The positioning of container 20 underneath the nozzle 14 to fill the container results in the pivoting of the lever 22. The pivotal state of the lever is sensed by a sensor, such as a switch 24. The open/closed state of the switch 24 is monitored by a control unit, such as a microcontroller 26.

When a container 20 is placed under nozzle 14 to be filled, the lever 22 is pivoted. Switch 24 undergoes an open/closed state transition. Microcontroller 26 interprets the detected state transition as indicating that there is a container 20 in place. Once, the microcontroller 26 makes this determination, the microcontroller sends the appropriate signal(s) to the dispensing unit 12 to cause the appropriate valve and/or pump actuation needed to cause beverage to be discharged from unit 12 through nozzle 14 into the container 20.

Microcontroller 26 also serves as part of the monitoring unit of system 10 of this invention. Specifically, microcontroller 26 outputs a digital pulse train of combined logical "ones" and "zeroes" (1's and 0's). In one embodiment of the invention, a random sequence of "1's" and "0's" is output as a pulse train from microcontroller 26. Micro-controller 26 thus serves as a signal generator that outputs a signal that may vary over time.

The 1s/0s pulse train from the microcontroller 26 is output to a drive buffer 28. From drive buffer 28, the pulse train is output into one input of a comparator 30. The pulse train is also output through a sense resistor 32 to a probe 34 mounted in nozzle 14. Probe 34 is positioned in nozzle 14 so as to be exposed to the beverage stream discharged from the nozzle.

The second input into comparator 30 is connected to the opposed end of sense resistor 32, that is, to the end of the resistor connected to probe 34. The output signal from the comparator 30 is applied to a receive buffer 36. Receiver buffer 36 forwards its output signal to microcontroller 26.

In system 10 of this invention, lever 22 functions as a second probe. A current is applied to lever 22 from a power supply 38 through a safety resistor 40. In FIG. 1, a transformer 42 is shown connected to the power supply 36. Transformer 42 converts the 120 VAC line voltage into a 24 VAC input voltage for the power supply 38, for safety reasons.

When lever 22 is pivoted as a result of a container 20 being placed under nozzle 14, microcontroller 26 actuates dispensing unit 12. Beverage flows from the dispensing unit 12 through nozzle 14 into the container 20. Simultaneously with the actuation of dispensing unit 12, microcontroller 26 generates the 1s/0s pulse train through drive buffer 28 into one input of comparator 30 and sense resistor 32. However, there is essentially no current present at the second input to comparator 30. Thus, comparator 30 outputs a constant signal at a saturation level.

Eventually, the discharged beverage fills and starts to overflow the container 20. In FIG. 1, container 20 is shown at a slight angle relative to counter surface 18. It should be appreciated that if container 20 is flat on the counter surface 18, the beverage does not overflow until the container is completely filled. Since the illustrated container 20 is angled, beverage overflows the container before the volume of beverage in the container equals the container volume. The volume of liquid in a beverage container at which overflow starts to occur is inversely proportional to the angle of the container 20 relative to counter surface 18.

Counter surface 18 is shown as being horizontal in FIG. 1. Thus, a user would have to hold the container 20 at an angle to position the container as shown. Alternatively, the counter surface 18 may itself be at an angle relative to the horizontal, so that even if the bottom of container 20 is supported by the counter surface, the container 20 tilts at an angle, so as to avoid the container becoming completely filled before the dispensing unit 12 is shut off.

Once the beverage overflows the container 20, a fraction of the overflow stream naturally flows over the lever 22. The beverage fluid stream is represented in FIG. 1 by dashed line 46, extending from the outlet of dispensing unit 12, over probe 34, through nozzle 14, into container 20 and over the lip of container 20 to pour onto lever 22, thereby to flow to counter surface 18. This beverage stream being conductive forms a conductive path between probe 34 and lever 22.

As a consequence of a conductive path being established between lever 22 and probe 34, current flows from the lever to the probe and to the opposed end of comparator 30. This takes the comparator 30 off of the saturation mode. Instead, comparator 30, upon receiving current from probe 34 outputs a 1s/0s pulse train that corresponds to the pulse train output by microcontroller 26. The output signal from comparator 30 is applied to receive buffer 36. The receive buffer 36 performs some filtering of the output signal. It is further understood that receive buffer 36, like drive buffer 28, also provides voltage protection to the microcontroller 26, as shown.

The pulse train output by the receive buffer 36 is applied as an input signal to the microcontroller 26. Microcontroller 26 digitally filters this signal to further remove the effects of noise. Microcontroller 26 also monitors the filtered input signal to determine the extent to which this received signal corresponds to the output signal. If these two signals match identically for a predetermined set of bits, in other words over a predefined period of time, microcontroller 26 interprets the data as indicating the system 10 is in an overflow state. The microcontroller 26 then terminates the delivery of beverage by the dispensing unit 12.

System 10 of this invention is thus configured to stop the dispensing beverage when the container 20, into which the beverage is delivered, overflows. The system 10 only terminates beverage discharge when, based on a signal received over a period of time, it has been determined that beverage is overflowing. This feature of system 10 of this invention significantly reduces the likelihood that, due to a false positive determination, beverage discharge will be terminated when the discharge is not actually overflowing.

Moreover, system 10 of this invention is further constructed so that the signal monitored is filtered prior to monitoring. This feature of the invention substantially eliminates the likelihood that, in the middle of the period in which the signals being compared are identical, a transient noise-induced voltage spike will cause the microcontroller 26 to determine that the signals are different. This would result in the microcontroller 26 making a false negative determination that beverage is not overflowing. However, since the voltage spikes that can cause this faulty interpretation are filtered out of the compared signal by the buffers 30, 36, the likelihood that such a determination will be made, and additional beverage lost, is appreciably reduced.

An alternative circuit 50 for sensing when dispensing system 10 is in an overflow state is now described by reference to FIG. 2. The circuit is based on a synchronous phase demodulator. This circuit 50 includes a relaxation oscillator 52 that includes two series connected inverters 54 and 56. Oscillator 52 also includes two series connected resistors 58 and 60. The free end of resistor 58 is connected to the input of inverter 54. The free end of resistor 60 is connected to the junction of inverter 54 and 56. A capacitor 62 is connected between the output of inverter 56 and the junction of resistors 58 and 60. In one version of the invention, resistors 58 and 60 and capacitor 62 are selected so that oscillator 52 generates a DC square wave having a duty cycle of 50%.

The output signal generated by oscillator 52, the output from inverter 56, is applied to a RC filter consisting of a resistor 64 and a series connected capacitor 66 that is tied to ground, as shown. The filter provides an integration to reduce the speed of the rise and fall time on the 50% duty cycle signal. The output signal from the filter, the signal present at the junction of resistor 64 and capacitor 66, is applied through a capacitor 68 to the dispenser lever 22. Capacitor 68 provides DC isolation to the drive circuit.

The output signal from oscillator 52 is also applied to the control pin of a 2:1 analog multiplexer 70. In one version of the invention, a NC7SB3157, available from Fairchild Semiconductor Corporation of Portland, Me., is employed as the analog multiplexer 70.

The nozzle probe 34 is connected to the inverting input of a differential amplifier 72 of the circuit 50 shown in FIG. 2. More particularly, any AC signal applied to probe 34 is applied to amplifier 72 through first a capacitor 74 and then a resistor 76. A pull-up resistor 78 is tied between a reference signal source (not illustrated), and the junction between capacitor 74 and resistor 76. A filter capacitor 80 is tied between this junction and ground. The Vref signal is applied through a resistor 82 to the noninverting input of amplifier 72. A feedback resistor 84 is connected between the output and inverting input of amplifier 72. The output signal from amplifier 72 is then applied through a resistor 86 to one of the input pins of analog multiplexer 70.

The output signal from amplifier 72 is also applied through a resistor 88 to the inverting input of a second differential amplifier, amplifier 92. The Vref signal is applied to the noninverting input of amplifier 92 through a resistor 94. A feedback resistor 96 is tied between the output of amplifier 92 and the inverting input. The output signal from amplifier 92 is applied to the second input pin of analog multiplexer 70 through a resistor 98.

The output pin of analog multiplexer 70 is tied to the inverting input of amplifier 106 through two series-connected resistors 102 and 104. A capacitor 110 is tied between the junction of resistors 102 and 104 and ground to form a RC filter with resistor 102. A capacitor 108 is tied between the output of analog multiplexer 70 and ground. Capacitor 108 provides filtering when the analog multiplexer 70 is switching between the two channels.

The Vref signal is applied to the noninverting input of amplifier 106 through a resistor 112. A feedback capacitor 114 is tied between the output of amplifier 106 and the inverting input. A feedback resistor 116 is tied between the output of amplifier 106 and the junction of resistors 102 and 104. The output signal generated by amplifier 106 is applied to the microcontroller 26. A capacitor 118 tied between the output of amplifier 106 and ground filters the output signal. Amplifier 106 and associated components thus function as a filter and as an integrator.

Oscillator 52 outputs the 50% duty cycle square wave signal. The signal is applied to lever 22. The signal from oscillator 52 is also applied to the control pin of analog multiplexer 70. Thus, this signal continually toggles the analog multiplexer 70 equally between its two input states.

When the microcontroller 26 receives a signal from switch 24 (FIG. 1), it will store a voltage level reading of the amplifier 106 output. The reading will provide a reference level of noise in the system. The microcontroller 26 then asserts the appropriate commands to the dispensing unit 12 (FIG. 1) to cause the discharge of beverage to start. As long as the beverage is not overflowing the container 20 (FIG. 1), there is no conductive path between lever 22 and probe 34. Amplifiers 72 and 92 are both configured to operate as inverting amplifiers. Thus, the reference voltage is applied through resistor 78 into the inverting input of amplifier 72. The output pin of amplifier 72 will go to the reference voltage as long as there is no difference between the inverting and noninverting inputs. The output of amplifier 72 is then applied to the inverting input of amplifier 92. The output pin of amplifier 92 will also go to a level equal to the difference between the inverting and non-inverting inputs. The level again is equal to the reference voltage. Thus, when no beverage is overflowing into the container, a voltage level equal to the reference is applied to the input pins of the analog multiplexer 70.

These voltage signals are toggled out of the analog multiplexer 70. Consequently, a charge equal to the reference voltage is able to develop on capacitor 110. Therefore, the output signal from amplifier 106 will be at the reference voltage as there is no difference between the inverting and noninverting inputs. This voltage level is monitored by the microcontroller 26.

When sufficient beverage has been delivered that the beverage overflows container 20, the overflowing beverage stream establishes a conductive path between lever 22 and probe 34. The signal output from oscillator 52, being applied to amplifier 72 through the lever 22 and probe 34, is either a positive pulse on the low to high volt transition or a negative pulse on the high to low volt transition. Amplifier 72, being referenced to a voltage in between the power supply and ground, will then invert this signal on top of the reference. The inverted signal is then itself inverted by amplifier 92 on top of the same reference.

The opposed inverted signals are simultaneously applied to the input pins of analog multiplexer 70. Collectively, the pulse train from oscillator 52 and the amplifier output signals are synchronized so that, when the oscillator 52 is generating a high signal, a voltage higher than the reference voltage is output from amplifier 92, that signal is allowed to pass through analog multiplexer 70, and when the oscillator 52 is generating a low signal, a voltage higher then reference voltage is output from amplifier 72, that signal is allowed to pass through analog multiplexer 70. Thus, when the beverage is overflowing container 20, a signal that is more positive then the reference voltage is continually being outputted from analog multiplexer 70. Therefore, amplifiers 72 and 92 and multiplexer 70 collectively function as a synchronized comparator. The synchronized comparator compares the signal from oscillator 52 to the signal between lever 22 and probe 34. When the signals are synchronized, the output signal is a voltage more positive then the reference voltage.

The positive voltage charges capacitor 110 to a voltage higher then the reference voltage. Amplifier 106 then inverts the voltage level and causes the output to go to a lower voltage. The signal from amplifier 106 is applied to microcontroller 26, and is interpreted by the microcontroller 26 as an indication that beverage has been overflowing the container 20 for a defined period of time. Microcontroller 26 then asserts the appropriate commands to the dispensing unit 12 (FIG. 1) to cause the discharge of beverage to stop.

It should be recognized that the foregoing description is directed to preferred embodiments of the invention. It is apparent, however, from the description, that alternative versions of the invention can be assembled from components different from those that have been described herein. For example, the two described signal generators, the random number generating microcontroller 26 and the relaxation oscillator 52, both generate digital pulse trains. In alternative versions of the invention, the signal generator may generate a varying-over-time analog signal.

Furthermore, while only two means are disclosed for comparing the output signal from the signal generator to the input signal received as a consequence of a conductive signal being established between the probes, a person having ordinary skill will recognize that other means may be employed. For example, the two signals may simply be applied to a comparator. Alternatively, digitized versions of analog signals may be compared by a processor such as a digital signal processor. If, for an appropriate period of time, the signals are identical to each other or, at least, are highly correlated, the processor interprets the signal state is indicating the system 10 has entered an overflow condition.

Moreover, it should be recognized that, according to this invention, the signal that flows over the beverage-completed circuit may be applied to either probe in contact with the beverage. Similarly, there is no requirement that the probe that is in contact with the discharged beverage stream always be positioned in the nozzle. In some versions of the invention, it may be desirable to place this probe in the conduit from the dispensing unit 12 that leads to the nozzle 14.

Likewise, the second probe need not always be a pivoting lever. Some dispensing units 12, for example, have plungers that a person invariably retracts in order to initiate the dispensing process. The second probe may be a conductive member integral with such a member. Alternatively, the second probe may serve no other function than being a probe that is positioned to be immersed in any overflow stream.

Also, a top-off circuit can be added. This top off circuit, not shown, may cause the monitoring unit to only assert the container filled signal for a short amount of time. This time period is approximately equal to the amount of time necessary to allow any foam head in the container 20 to dissipate. Once the container-filled signal is negated, the monitoring unit allows dispensing unit 12 to again fill, and thus to "top off" the beverage.

Therefore, it is an object of the appended claims to cover all such variations and modifications that come within the true spirit and scope of the invention.

What is claimed is:

1. A beverage overflow monitoring system for use with a beverage dispenser, said overflow monitoring system comprising:

a signal generator that generates a varying-over-time master signal;

a pair of spaced apart conductive probes, one said probe positioned to be in contact with a beverage stream discharged from the beverage dispenser, the other said probe positioned to be in contact with a beverage stream that overflows from a container into which the beverage stream is discharged, wherein said signal generator is connected to a first one of said probes to apply the master signal to said probe;

a comparator, said comparator being connected to said signal generator to receive the master signal and to a second one of said probes to receive the signal generated as a consequence of the beverage stream establishing a conductive path between said probes, said comparator configured to compare the received signals and to generate a select comparator output signal when the received signals are substantially identical; and a timer connected to said comparator for receiving the select comparator output signal, said timer configured to generate an overflow signal when the select comparator output signal is received for a predetermined time period.

2. The beverage overflow monitoring system of claim 1, wherein said signal generator generates a digital signal.

3. The beverage overflow monitoring system of claim 1, wherein said comparator and said timer are part of a single microcontroller.

4. The beverage overflow monitoring system of claim 1, wherein said timer comprises an integrator that integrates the select comparator output signal.

5. The beverage overflow monitoring system of claim 1, wherein said signal generator applies the master signal to said probe positioned to be in contact with the beverage stream discharged from the beverage dispenser.

6. A beverage dispensing system, said system comprising:

a dispensing unit that discharges a beverage stream in response to a control signal;

a first conductive probe positioned to be in contact with the beverage stream discharged from said dispensing unit;

a second conductive probe positioned to be in contact with beverage that overflows a container, the container being positioned to receive the discharged beverage stream;

a signal generator that generates a varying-over-time master signal, said signal generator connected to one of said probes to output the master signal to said probe;

a comparator, said comparator connected to said signal generator to receive the master signal and connected to a second one of said probes to receive the signal generated as a consequence of the beverage establishing a conductive path between said probes, said comparator configured to compare the received signals and to generate a select comparator output signal when the received signals are substantially identical;

a timer connected to said comparator to receive the select comparator output signal, said timer configured to generate an overflow signal when the select comparator output signal is received for a predetermined time period; and a control unit connected to said dispensing unit for generating control signals to said dispensing unit and to said timer for receiving the overflow signal, said control unit configured to, upon receipt of the overflow signal, generate a control signal to said dispensing unit to cause said dispensing unit to terminate beverage discharge.

7. The beverage dispensing system of claim 6, wherein said signal generator generates a digital signal.

8. The beverage dispensing system of claim 6, wherein said comparator and said timer are part of a single microcontroller.

9. The beverage dispensing system of claim 6, wherein said signal generator, said timer and said control unit are parts of a single microcontroller.

10. The beverage dispensing system of claim 6, wherein said signal generator generates a master signal that randomly varies over time.

11. The beverage dispensing system of claim 6, wherein said signal generator applies the master signal to said first probe.

12. The beverage dispensing system of claim 6, further including a power supply, said power supply generating a power signal that is applied to the said conductive probe not connected to said signal generator.

13. The beverage dispensing system of claim 6, further including:

a dispensing head from which said dispensing unit discharges the beverage;

a contact probe moveably attached to said dispensing unit or said dispensing head, said contact probe positioned to be moveably displaced by the placement of a container underneath said dispensing head, thereby defining said second conductive probe; and a sensor connected to said contact probe that monitors the displacement of said contact probe and that generates a sensor signal representative of the displacement of said contact probe, wherein said control unit receives the sensor signal and, in response to the sensor signal indicating the displacement of said contact probe, said control unit generates a control signal to said dispensing unit to cause the discharge of beverage.

14. A method of determining if the beverage discharged from a beverage dispensing unit is overflowing a container into which the beverage is discharged, said method including the steps of:

generating a master signal that is variable over time;

applying the master signal to either a first conductive probe positioned to be in contact with the beverage stream discharged from the dispensing unit or a second conductive probe positioned to be in contact with an overflow beverage stream from the container;

comparing the master signal to a conductive signal transmitted between the probes by the beverage streams; and when said comparison indicates said signals are at least substantially identical, timing the period for how long the signals are at least substantially identical, and when the signals are at least substantially identical for a select period of time, establishing the beverage dispensing unit to be in an overflow state.

15. The method of determining if the beverage discharged from a dispensing unit is overflowing of claim 14, wherein, in said step of generating a master signal, a digital master signal is generated.

16. The method of determining if the beverage discharged from a dispensing unit is overflowing of claim 14, wherein, in said step of generating a master signal, a master signal that varies randomly over time is generated.

17. The method of determining if the beverage discharged from a dispensing unit is overflowing of claim 14, wherein said second conductive probe is a moveable probe positioned to be displaced upon the placement of a container adjacent the dispensing unit so as to receive the discharged beverage.

18. The method of determining if the beverage discharged from a dispensing unit is overflowing of claim 14, wherein:

when said comparing step indicates the compared signals are at least substantially identical, a constant signal is asserted; and said timing step is performed by integrating the constant signal.

19. The method of determining if the beverage discharged from a dispensing unit is overflowing of claim 14, wherein in said applying step, the master signal is applied to the second conductive probe.

20. The method of determining if the beverage discharged from a dispensing unit is overflowing of claim 14, wherein in said applying step, the master signal is applied to the first conductive probe, and comprising a further step in which a power signal is applied to the second conductive probe.

* * * * *